US007472669B2

(12) United States Patent
Hedman

(10) Patent No.: US 7,472,669 B2
(45) Date of Patent: Jan. 6, 2009

(54) METHOD OF GENERATING PRESSURE PULSES, A PRESSURE PULSE GENERATOR AND A PISTON ENGINE PROVIDED THEREWITH

(75) Inventor: Mats Hedman, Sparreholm (SE)

(73) Assignee: Cargine Engineering AB, Stockholm (SE)

( * ) Notice: Subject to any disclaimer, the term of this patent is extended or adjusted under 35 U.S.C. 154(b) by 313 days.

(21) Appl. No.: 10/591,236

(22) PCT Filed: Feb. 25, 2005

(86) PCT No.: PCT/SE2005/000270

§ 371 (c)(1),
(2), (4) Date: Aug. 31, 2006

(87) PCT Pub. No.: WO2005/083239

PCT Pub. Date: Sep. 9, 2005

(65) Prior Publication Data

US 2007/0175423 A1 Aug. 2, 2007

(30) Foreign Application Priority Data

Mar. 1, 2004 (SE) ..... 0400503

(51) Int. Cl.
*F01L 9/02* (2006.01)

(52) U.S. Cl. ..... 123/90.12; 123/90.11; 123/90.14; 137/625; 251/129.15; 92/85 B

(58) Field of Classification Search ..... 123/90.11, 123/90.12, 90.13, 90.14; 251/129.01, 129.02, 251/129.03, 129.15; 137/625, 625.65, 625.69, 137/625.34; 91/392; 92/85 A, 85 B
See application file for complete search history.

(56) References Cited

U.S. PATENT DOCUMENTS 6,067,946 A 5/2000 Bunker et al.
7,243,624 B2 * 7/2007 Kenchington ..... 123/90.12

FOREIGN PATENT DOCUMENTS

WO WO 02/04790 1/2002
WO WO 03/102385 12/2003

* cited by examiner

*Primary Examiner*—Ching Chang
(74) *Attorney, Agent, or Firm*—Young & Thompson

(57) ABSTRACT

A pressure pulse generator includes a pressure pulse transmitting body displaceably arranged in a chamber divided by the body into a first and a second part, a first spring and a second spring, arranged to displace the body in a first direction and a second direction respectively in the chamber, a first conduit leading between a high pressure source and a first part of the chamber, wherein the pressure fluid in the first part acts on the body for displacing the latter in the second direction, and elements for opening/interrupting a communication between the first part and the high pressure source through the first conduit. The opening/interrupting elements interrupt communication while the body is displaced in the first direction from a predetermined starting position through a triggering of the first spring, and maintain communication while the body is displaced in the second displacement direction back to the starting position, whereby a biasing of the first spring is accomplished.

20 Claims, 8 Drawing Sheets

METHOD OF GENERATING PRESSURE PULSES, A PRESSURE PULSE GENERATOR AND A PISTON ENGINE PROVIDED THEREWITH

TECHNICAL FIELD

The present invention relates to a method of generating pressure pulses in accordance with the preamble of patent claim 1.

It also relates to a pressure pulse generator according to the preamble of patent claim 7, and a piston engine provided therewith.

The pressure pulses generated by a first spring, that might be a pressure fluid spring or a mechanical spring, are suitably used for controlling and operating an inlet or outlet valve to the combustion chamber of a combustion engine. The pressure pulse transmitting body may then be an integrated part of such a valve, preferably the valve stem in the case when the pressure fluid is a liquid, or a piston connected with the valve stem and driven in a cylinder, in case the pressure fluid is a gas. Alternatively, said body may be separate and arranged to act against an existing valve stem. The pressure pulse generator and the method of controlling the latter can be used for the purpose of controlling the height of lift of the valves, i.e. how much the valves are to open, and the opening times of the valves, i.e. the crank angle grade at which the opening and closure thereof is to take place.

Pressure pulses that are generated by means of a pressure pulse generator may also be used for the purpose of controlling the movements of a piston, a VCR-piston (VCR=Variable Combustion Ratio), for the variation of the cylinder volume of a combustion chamber, and, accordingly, the compression ratio, of a combustion engine. If the pressure fluid is a liquid, the pressure pulse transmitting body is, suitably, a stem that acts against or is connected with such a piston, said piston then being displaceably arranged back and forth in a cylinder connected with the combustion chamber. If the pressure fluid is a gas, it can be permitted to act directly against the piston on a side thereof opposite to the one that is directed towards the combustion chamber. The spring load that acts on the pressure pulse transmitting body in a direction towards the chamber of the pressure pulse generator may then be a direct result of the gas pressure that exists in said cylinder, and the combustion chamber, or may, but need not, be accomplished by means of a physical spring.

Suitably, the pressure pulse generator comprises a control unit that, electronically, and based on the position of the pressure pulse transmitting body or the position of a piston in a piston engine (crank angle grade), controls valves for the regulation of the flow of the pressure fluid and, thereby, the initiating of the pressure pulses.

"Conduct", as it is used in this application, should also be regarded in a wide sense, and may, accordingly comprise a tubular conduit or a conduit formed by a channel arranged in a piece of material.

The invention is based on the realization that a spring for the displacement of a pressure pulse transmitting body can be preloaded and triggered through a suitable control of a pressure fluid flow in a pressure fluid circuit, independently of whether the spring is of a pressure fluid type or a mechanical type.

THE BACKGROUND OF THE INVENTION

It is widely known to drive spring loaded poppet valves of combustion engines, hereinafter named engine valves, by means of a hydraulic pressure pulse generator. For example, U.S. Pat. No. 6,067,946 discloses the opening of an engine valve by an application of a hydraulic pressure onto a piston that is connected to the valve. The hydraulic pressure either comes from a high pressure source or a low pressure source. The application of the hydraulic pressure is performed by means of a pressure control device based upon signals that are received from an electronic control member. The hydraulic pressure is applied in such a way as to minimize the energy that is required for the activation of the valve while, at the same time, the inertia of the valve is taken advantage of. The described system comprises means for opening/interrupting the communication between the high pressure source and the chamber in which the piston is arranged, and means for opening/interrupting the communication between the low pressure source and said chamber.

The method disclosed in U.S. Pat. No. 6,067,946 includes that the high pressure source is brought into communication with the chamber while the valve is displaced in a direction out of the chamber, i.e. to the opening position of the valve. When the valve gets close to a maximally open position, the communication between the chamber and the high pressure source is interrupted and, instead, a communication between the chamber and the low pressure source is opened. In that way, a braking of the valve is accomplished before it reaches its end position. When the valve has reached this position, it can be locked in that position by interrupting both of said communications. When the valve is to return to its closed position, the communication between the low pressure source and the chamber is re-opened, whereby the pre-loaded spring force displaces the piston into the chamber. When the valve is close to its closed position, the home position, the communication between the high pressure source and the chamber is opened and the communication between the low pressure source and the chamber is interrupted. In that way, a braking of the movement in this direction is achieved. When the valve has reached its home position both communications may be interrupted to keep the valve in this position. In this way, the time during which the valve is open is controlled.

The drawback of this prior art is that the hydraulic liquid which comes from the high pressure source and is used for the projection of the valve to the open position thereof is almost completely further conducted to the low pressure source, whereby there is a significant loss of energy.

THE OBJECT OF THE INVENTION

It is an object of the present invention to provide a method and a pressure pulse generator that make it possible to minimize the energy losses in connection to a pressure pulse generation, in particular in connection to a displacement of an engine valve of a combustion engine between the opened and closed positions thereof or a displacement of a VCR piston between its required positions in connection to the operation of a combustion engine, the combustion chamber of which the piston is associated to.

A further object of the invention is to achieve the primary object with a pressure pulse generator design which is as uncomplicated and reliable as possible.

SUMMARY OF THE INVENTION

The object of the present invention is achieved by means of the method defined in the preamble of patent claim 1, characterized in that the communication between the first part of the chamber and the high pressure source is kept interrupted while the body is displaced in the first direction from a predetermined starting position through a triggering of the first spring, and that the communication between the first part of the chamber and the high pressure source is kept open while the body is displaced in the second displacement direction back to said starting position, whereby a biasing of the first spring is accomplished.

Suitably, the pressure pulse transmitting body acts against or forms part of a valve, hereinafter named an engine valve, to the combustion chamber of a combustion engine. Alternatively, it acts against, or forms part of a VCR-piston for controlling the compression volume of a combustion chamber of a combustion engine. Normally, a displacement of the pressure pulse transmitting body in the first direction will result in an opening of the engine valve, that is, a displacement thereof from a closed position, in which it bears against a seat, or a reduction of the compression volume of the combustion chamber by a displacement of a VCR-piston.

The first and second springs may be of a mechanical, pneumatic or hydraulic type. In connection to the triggering of the first spring, the latter will, during the subsequent motion, transfer energy to the second spring, which, thereby, passes to a compressed condition. A dead position is reached, corresponding to the maximum or required opening of an engine valve or to the requested position of a VCR-piston. In this position, it is possible, but not necessary, to lock the engine valve. A VCR-piston, however, must be locked in this position in some way. We will return later to how this can be achieved in practice. After having reached the end position, in which the second spring is in a biased condition, the second spring will displace the engine valve or the VCR-piston back to the starting position. Due to losses in connection to the displacement movements, a complete return to the starting position will not, however, take place. The invention suggests the use of a pressure fluid with high pressure as an assistance for the accomplishment of a complete return to the starting position. In a parallel patent application filed by the applicant, there is a suggestion of how to, in the case of a hydraulic or a pneumatic first spring, achieve such a return by means of a draining of the pressure fluid from the chamber in which the pressure pulse transmitting body is arranged to be displaced. The present application and said parallel application disclose two different principles for returning a pressure pulse transmitting body of a pressure pulse generator to its starting position.

According to the invention, the communication between the first part of the chamber and the high pressure source is opened during a period which is sufficient for a complete return of said body to the starting position through the action of the pressure fluid and the second spring.

The communication between the first part of the chamber and the high pressure source is, preferably, open during a final stage of the displacement in the second direction, by which the action of the second spring is insufficient for completely returning said body to the starting position.

A communication between the first part of the chamber and the high pressure source is kept open for a period during which a retention of said body in the starting position is required.

Then, when a triggering is once again to take place, this is done by means of a depressurization in the first part of the chamber. According to one embodiment, the pressure pulse generator comprises a conduit that leads between the first and second parts of the chamber, and means for opening/interrupting the communication between said parts through this conduit, wherein this communication is kept interrupted while the communication between the high pressure source and the first part of the chamber is kept open, and is kept open while the communication between the high pressure source and the first part of the chamber is kept interrupted.

According to the invention, it is preferred that the pressure pulse generator comprises a conduit that leads between the first part of the chamber and a low pressure source, and means for opening/interrupting the communication through this conduit, and that said communication is kept interrupted when the communication between the high pressure source and the first part of the chamber is kept open. Said communication should be open during the time when the communication between the high pressure source and the first part of the chamber is interrupted, in order to enable fluid to flow freely into or out of the first part of the chamber during that part of the displacement movement when no high pressure should be applied for completing displacement thereof to the starting position.

According to one embodiment, the invention includes that the pressure pulse generator comprises a conduit for communication between a low pressure source and the second part of the chamber, and means for opening/interrupting this communication, and that this communication is interrupted when the pressure pulse transmitting body, after having been displaced in the first direction, has reached an end position, which is opposed to the starting position, for the purpose a locking the body in its end position. Thereby, the communication is interrupted in the sense that any flow in a direction towards the low pressure source is interrupted/stopped. In that way, it is possible to control the period during which the valve is open in the case of an engine valve. In the case of a VCR-piston, the latter can, in this way, be locked in the position that is requested for the accomplishment of a required compression volume of the combustion chamber.

The object of the invention is also achieved by means of the pressure pulse generator defined in the preamble of patent claim 7, characterized in that the means for opening/interrupting the communication between the first part of the chamber and the high pressure source are arranged to interrupt the communication therebetween while the body is displaced in the first direction from a predetermined starting position through a triggering of the first spring and arranged to keep the communication between the first part of the chamber and the high pressure source open while the body is displaced in the second displacement direction back to said starting position, whereby a pre-loading of the first spring is accomplished. The arrangement of the means for opening/interrupting the communication between the first part of the chamber and the high pressure source includes the use of means for sensing the displacement position of the pressure pulse transmitting body for the purpose of activating the first-mentioned means at a requested time. Alternatively, said activation could be based on the time that has passed from a preceding activation or deactivation of the first-mentioned means.

As to the rest, the pressure pulse generator is, preferably, designed in the way that has been described above in connection to the summery of the method according to the invention.

The means for opening/interrupting the communication in the conduit between the first part of the chamber and the high pressure source preferably comprises a solenoid-activated valve body.

Preferably, also the means for opening/interrupting the communication in the conduit between the first part of the chamber and the low pressure source comprises a solenoid-activated valve body, as well as the means for opening/interrupting the communication between the second part of the chamber and the low pressure source.

It is preferred that the pressure pulse generator comprises or is connected to a control unit, that has a computer program for controlling the pressure pulse generator in accordance with the method according to the invention.

Further, the invention relates to a piston engine with a valve for the introduction or discharge of air or an air/fuel mixture in relation to a combustion chamber, characterized in that it comprises a pressure pulse generator according to the invention, for driving at least one such valve by means of pressure pulses. Normally, such an engine comprises valves both for the introduction and the discharge, and, preferably, both these categories of valves are driven by a pressure pulse generator according to the invention.

The invention also relates to a piston engine with a VCR-piston in connection to a combustion chamber of the engine, characterized in that it comprises a pressure pulse generator according to the invention for driving the VCR-piston.

Further features and advantages of the present invention will be disclosed in the following, detailed description.

BRIEF DESCRIPTION OF THE DRAWINGS

Hereinafter, the invention will be described byway of example, with reference to the annexed drawings, on which.

DETAILED DESCRIPTION OF THE INVENTION

Figure 1:
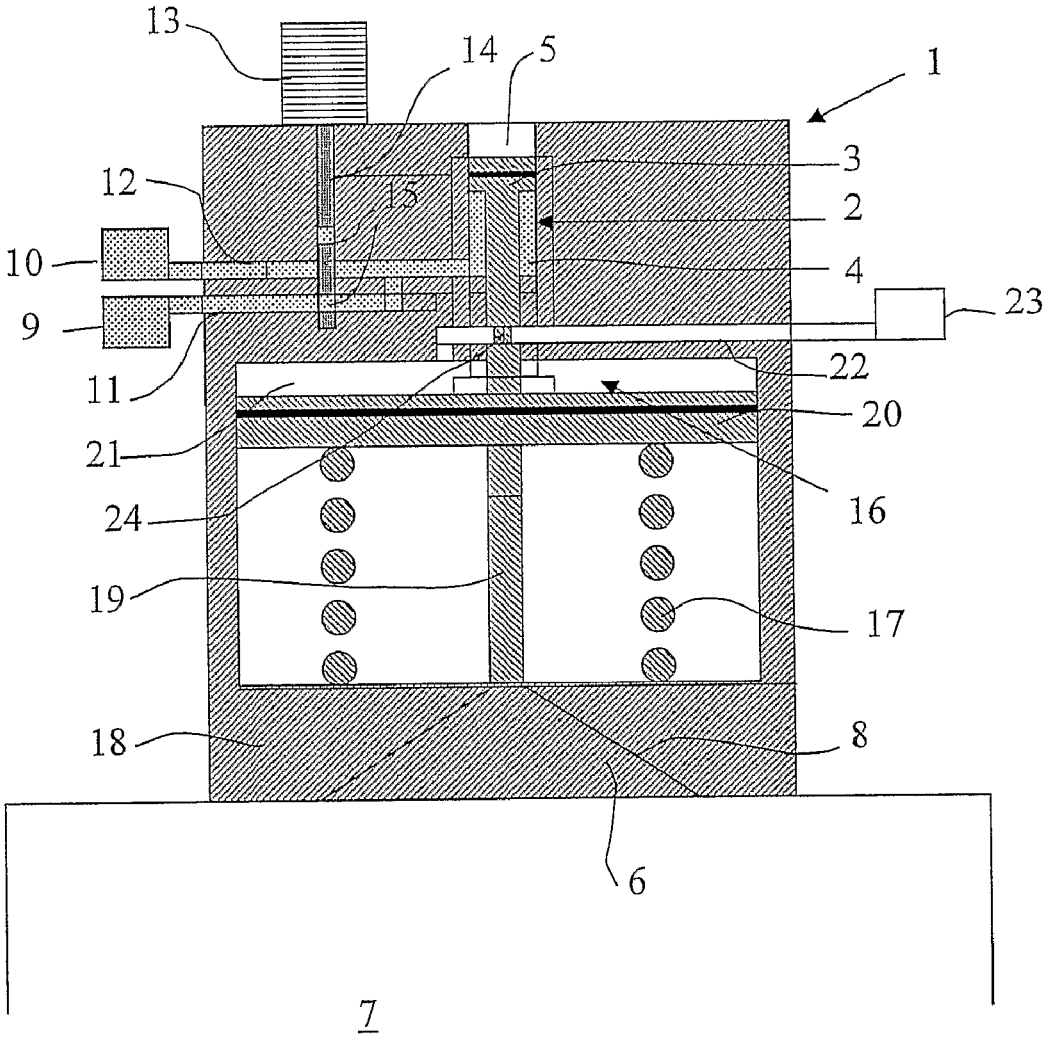
FIG. 1 is a schematic cross section of a pressure pulse generator according to a first embodiment of the invention.

FIG. 1 shows a pressure pulse generator according to a first embodiment of the present invention. The pressure pulse generator comprises a house or a body 1, in which there is provided a chamber 2. The chamber 2 is, preferably, cylindric. A pressure pulse transmitting body 3 is displaceably arranged in the chamber 2. This pressure pulse transmitting body 3 constitutes a piston that, at its outer periphery, is tightly arranged in relation to the wall of the chamber 2. The body 3 divides the chamber in a first part 4 and a second part 5. The chamber 2 is, in this case, not closed, since, in this case its second part 5 is in a direct communication with the environment, which might be the atmosphere.

In this embodiment, the pressure pulse transmitting body 3 constitutes a part of a valve 6 to the combustion chamber 7 of a combustion engine. However, the body 3 may be separate and arranged to act on, in other words displace, the valve 6. The piston portion of the body 3 is connected with the engine valve 6 through a stem that has a smaller cross section than the piston portion. Said stem penetrates the first part 4 of the chamber 2 and permits a fluid in said first part to act on the part of the cross section area of the piston that is not covered by the cross section of the stem. The stem projects tightly out of the chamber 2 and through the wall of the house 1. The valve 6 may function as an inlet valve for a fuel mixture, or as an outlet valve for exhaust gases. The pressure pulse generator is supposed to operate as an alternative to a conventional cam shaft for controlling the opening and closing movements of the valve 6. In the wall of the combustion chamber 7, here in the cylinder head, a seat 8 is provided as is usual, and in its closed position, the valve 6 rests against said seat.

Figure 2:
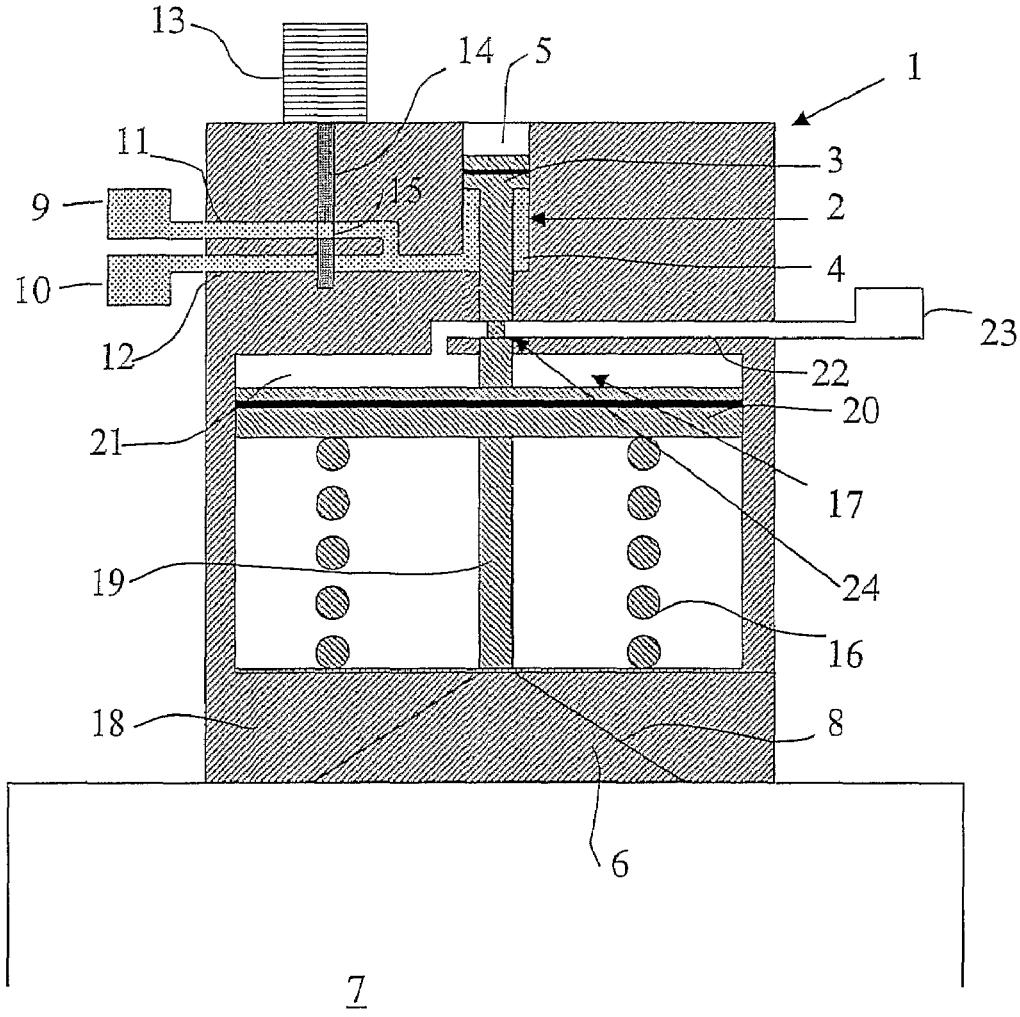
FIG. 2 is a second embodiment of the pressure pulse generator according to the invention.

The pressure pulse generator also comprises a high pressure source 9 and a low pressure source 11 for a pressure fluid, which may either be gaseous or liquid. The low pressure source may, for example, in the case when the liquid is an oil that belongs to the oil system of a combustion engine, be constituted by an oil trough that belongs to the engine. It should be realized that a pump or a compressor (not shown) should be provided in connection to the pressure pulse generator, or form a part thereof, for the purpose of generating said high pressure, and thereby constituting the high pressure source. A first conduit 11 leads between the first part 4 of the chamber 2 and the high pressure source 9, while a second conduit 12 leads between the first part 4 of the chamber 2 and the low pressure source 10. Furthermore, there is a means, constituted by a valve body or slide valve 14 activated by a solenoid 13, for the opening/interrupting of the communication between the first part 4 of the chamber 2 and the high pressure source 9 through the first conduit 11. The same solenoid-activated valve body 14 also constitutes a means for opening/interrupting the communication between the first part 4 of the chamber 2 and the low pressure source 10 through the second conduit 12. This double function of the slide valve 14 is achieved since it is provided such that it intersects the two conduits 11, 12 and is provided with openings 15 that, in predetermined positions, open the conduits 11, 12. The slide valve 14 is arranged to open for a communication in one of the conduits 11, 12 when it interrupts the communication in the other one of said conduits. The two openings 15 may be replaced by only one opening, such as shown in FIG. 2. The control of the flow of pressure fluid in the conduits 11 and 12 will be described more in detail later.

Suitably, the pressure pulse generator comprises a control unit (not shown), for example a computer unit with a software and a processor, for controlling the means 13, 14 for opening/interrupting the communication between the first part 4 of the chamber 2 and the high pressure source 9 and the low pressure source 10 respectively. The control is based on the position of a piston in the combustion engine 7 of the combustion engine. Therefore, it should be realized that a combustion engine according to the invention should be provided with means (not shown) for sensing the position of the piston, in other words, the crank angle, and that the control is based on signals that define said position.

Further, the pressure pulse generator comprises a first spring 16 and a second spring 17, arranged to displace said body in a first direction and a second direction respectively in the chamber 2. In the embodiment shown in FIG. 1, the second spring 17 is a mechanical spring that is arranged between the wall 18 of the combustion engine 7 and a support plate 20 connected with the stem 19 of the valve 6. The second spring strives to close the valve 6, in other words, to press it against the seat 8.

In this case, the first spring 16 is of a pneumatic type. A piston connected with the stem 19 of the engine valve 6, in this case constituted by a support plate 20, delimits, together with the surrounding walls of the previously mentioned house 1, a chamber 21 that, through a conduit 22, leads to a high pressures source 23, for example constituted by a compressor, for a gas or a gas mixture, for example air. Further, there is a means 24 for opening/interrupting the communication between the chamber 21 and the associated high pressure source 23. Here, said means is constituted by a tapering or an opening 24 in the stem 19 of the valve 6, said stem being arranged to intersect the conduit 22 and said opening or tapering 24 being arranged to open for a communication between the chamber 21 and the associated high pressure source 23 when located in a predetermined position, in this case corresponding to the closed position of the valve, the home position. In all other displacement positions, the valve stem 19 interrupts the communication in the conduit 22. This means that the pneumatic first spring 16 is biased in a home position, and, thereby, absorbs energy that has been used during a previous valve movement. As soon as the engine valve is displaced, a communication with the high pressures source that is associated with the chamber will cease. The compressed fluid in the chamber 21 will then expand against the action of the second spring 17 and will cause a displacement of the engine valve, if the pressure is sufficient.

In order to accomplish a pressure pulse that results in an opening and a subsequent closing movement of the engine valve 6, the means for opening and interrupting the communication in the first and second conduits shall be controlled in the following way with reference to the starting position shown in FIG. 1: In the starting position the communication between the first part 4 of the chamber and the high pressure source 9 is open, and the communication between the first part 4 of the chamber and the low pressure source 10 is interrupted. Initially, the solenoid 13 is activated (or deactivated, depending on the type of solenoid which is used (pulling or pushing)), whereupon the slide valve body 14 associated thereto is displaced to a position in which the communication between the high pressure source 9 and the first part 4 of the chamber is interrupted, and the communication between the low pressure source and the first part 4 of the chamber is opened. Thereby, the pressure acting on the pressure pulse transmitting body in a second direction (upwards in the figure), and which depends on the fluid in the first part 4 of the chamber, ceases. The pre-loaded pneumatic spring 16 will thereby be triggered and will displace the pressure pulse transmitting body 3, including the engine valve 6, in a direction downwards in the figure, that is in a direction that results in the engine valve 6 being opened. The displacement takes place while energy is transferred from the first spring 16 to the mechanical, second spring 17, which becomes biased, or compressed. At a certain displacement position, which depends on the spring rate of the second spring 17 and the pressure of the high pressure source 23, that has delivered the pressure fluid to the chamber 21 associated thereto, an end position of the engine valve 6 is reached. The energy that is now stored in the second spring 17 will displace the pressure pulse transmitting body 3 and the engine valve 6 back in a direction towards the starting position. However, there has been energy losses during the displacement, and the energy that is stored in the second spring 17 is insufficient for a complete returning of the engine valve 6 to the starting position, in other words, to its closed position. At a predetermined position, or at a predetermined position of the pressure pulse transmitting body 3, or at the detection of the fact that the pressure fluid flow out of the first part 4 of the chamber 2 or out of the chamber 21 decreases or ceases, the solenoid is once again activated, in order to return to the starting position that is shown in FIG. 1. Thereby, the first part 4 of the chamber is provided with a high pressure that contributes to the returning of the engine valve 6 to its closed starting position, and to the retention of the valve in this position until the moment at which the pressure pulse transmitting body once again, by means of a control similar to the one that has been described, is permitted to open and close the engine valve. It should be realized that the pressure pulse generator, in order to enable such a precise control of the active components, in this case the solenoid 13, should be operatively connected with, or provided with any type of sensor that either senses the movement of the pressure pulse transmitting body 3 or the flow in any of said conduits 12, 22, in order to enable an activation of said solenoid 13 with a correct timing upon basis of a signal from said sensor. Alternatively, it will be possible to, by predetermined operating conditions, activate the solenoid upon basis of the time that has passed from the triggering of the first spring.

FIG. 2 shows a modified version of the pressure pulse generator in FIG. 1, wherein the difference is that there is only one opening 15 provided in the solenoid-activated slide valve body 14.

Figure 3:
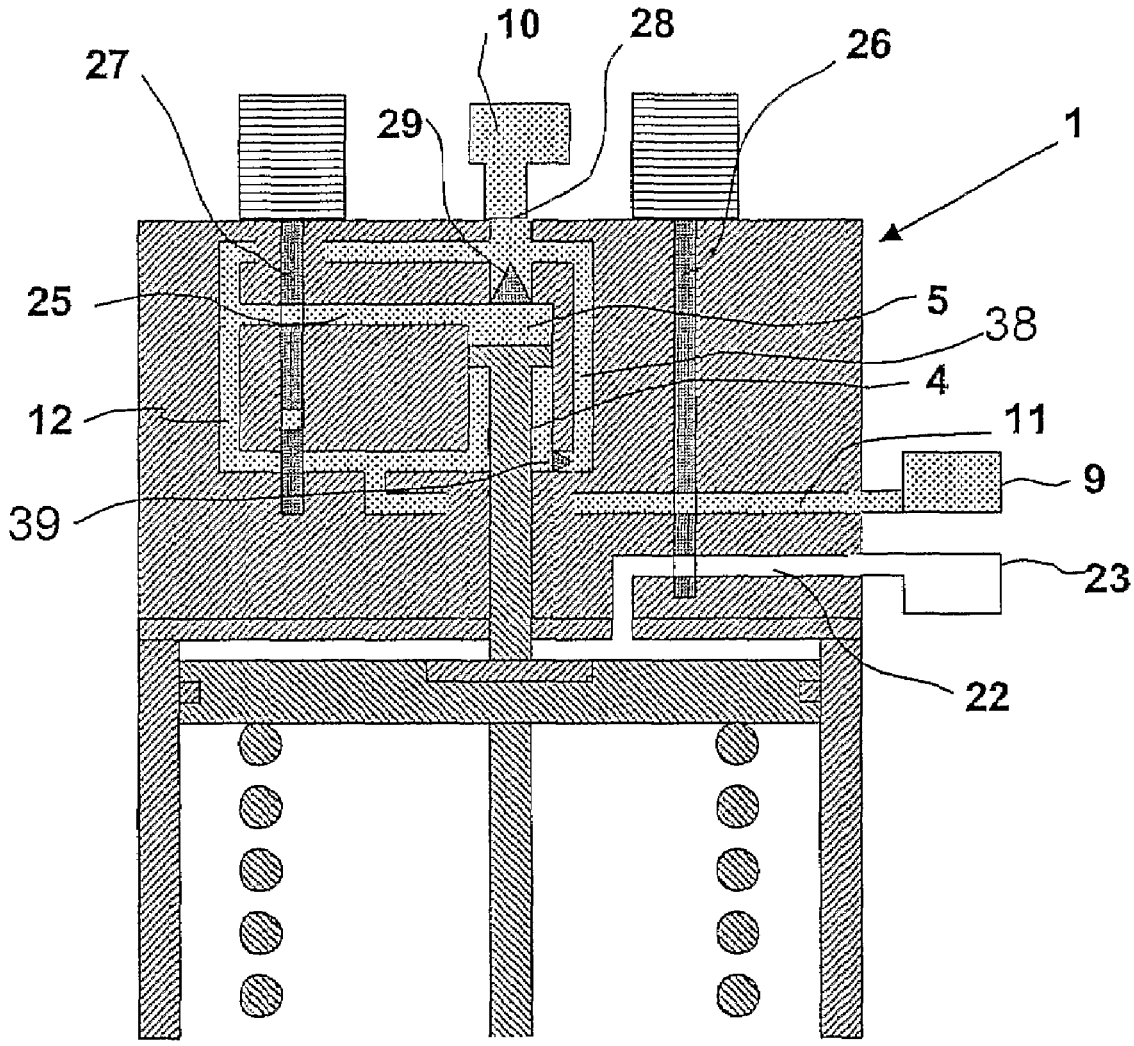
FIG. 3 shows a third embodiment of the pressure pulse generator according to the invention.
Figure 6:
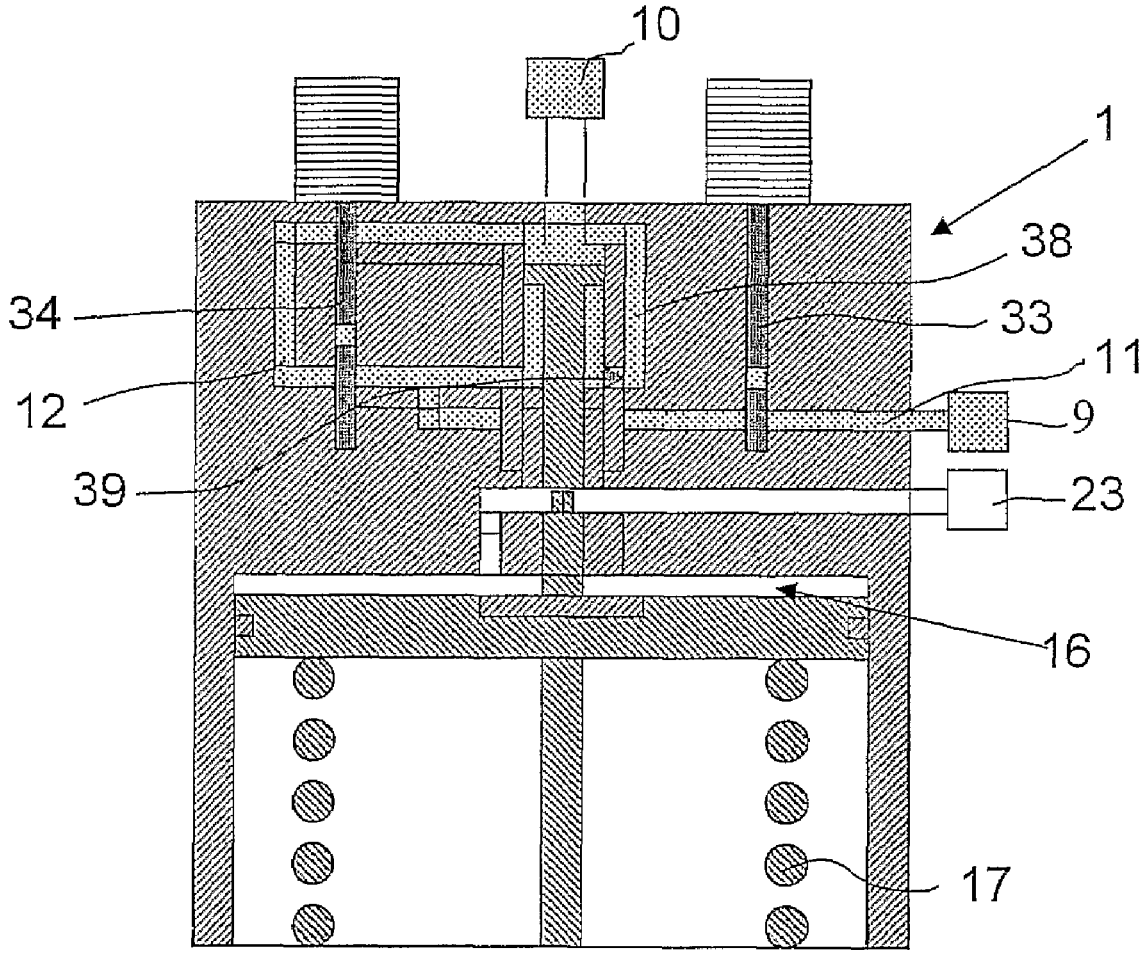
FIG. 6 shows a sixth embodiment of the pressure pulse generator according to the invention.

FIG. 3 shows an alternative embodiment of the pressure pulse generator according to the invention. Likewise to the preceding embodiments, there is a first conduit 11 that leads from the first part 4 of the chamber to a high pressure source 9, and a second conduit 12 that leads from the first part 4 of the chamber to a low pressure source 10. There is also a third conduit 25 that leads from the second part 5 of the chamber to a low pressure source. A solenoid-activated slide valve 26 controls the flow in the conduit 11 to said high pressures source 9, and is also arranged to open/interrupt the communication in the conduit 22, that leads between the further high pressure source 23 and the chamber 21 that, together, constitute the pneumatic first spring 16. A further solenoid-activated slide valve 27 opens/interrupts the communication in the second conduit 12 and in the third conduit 25. A fourth conduit 28, to which the second and third conduits are connected, also lead from the second part 5 of the chamber to the low pressure source 10. A non-return valve 29 is arranged in the fourth conduit 28 for the purpose of preventing a direct flow through this conduit from the second part of the chamber 5 to the low pressure source 10, but to permit a flow in the opposite direction. A fifth conduit, or a channel 38, extends from the low pressure source 10 to the first part 4 of the chamber. A non-return valve 39 provided therein prevents a flow from the second part 4 to the first part 5, but opens for a flow in the opposite direction, which is necessary in order to permit the first part of the chamber to be filled with a pressure fluid during a returning movement to the starting position, without any opening of the communication between the high pressure source 9 and the first part 4 of the chamber. A corresponding solution is also shown in FIG. 6.

The function is the following: when the first spring 16 is to be triggered, the communication in the conduits 11, 22 to the first and second high pressure sources 9, 23 is interrupted. Simultaneously, or subsequent thereto, the communication in the second conduit 12 is opened in order to permit a flow of fluid from the first part 4 of the chamber to the low pressure source 10. The communication in the third conduit may, as in this case, but need not, be interrupted during this stage. The non-return valve 29 guarantees that a fluid can flow from the low pressure source 10, and, possibly, from the first part of the chamber through the second and fourth conduits 12, 28, into the second part 5 of the chamber. When the engine valve has reached an end position, in which the energy largely has been transferred from the first spring 16 to the second spring 17, there is no possibility for the fluid to flow out of the second part 5 of the chamber, since the communication in the third conduit 25 is to be interrupted in this position. Thereby, a locking has been accomplished in the end position. When a return to the starting position is requested, the communication in the third conduit 25 is opened. In order to achieve a complete return to the starting position, it is necessary to reopen the communication in the first conduit 11 at the end of the returning movement. When the pressure pulse generator is designed as in this embodiment, and also as in the preceding one, the communication in the conduit 22, that connects the chamber 21 with the further high pressure source 23, will also be opened. It should be realized that there will be opposing forces, but that the pressure in the first high pressure source 9 is such that the force of the pneumatic spring 16 is overcome, and the starting position is obtained.

Figure 4:
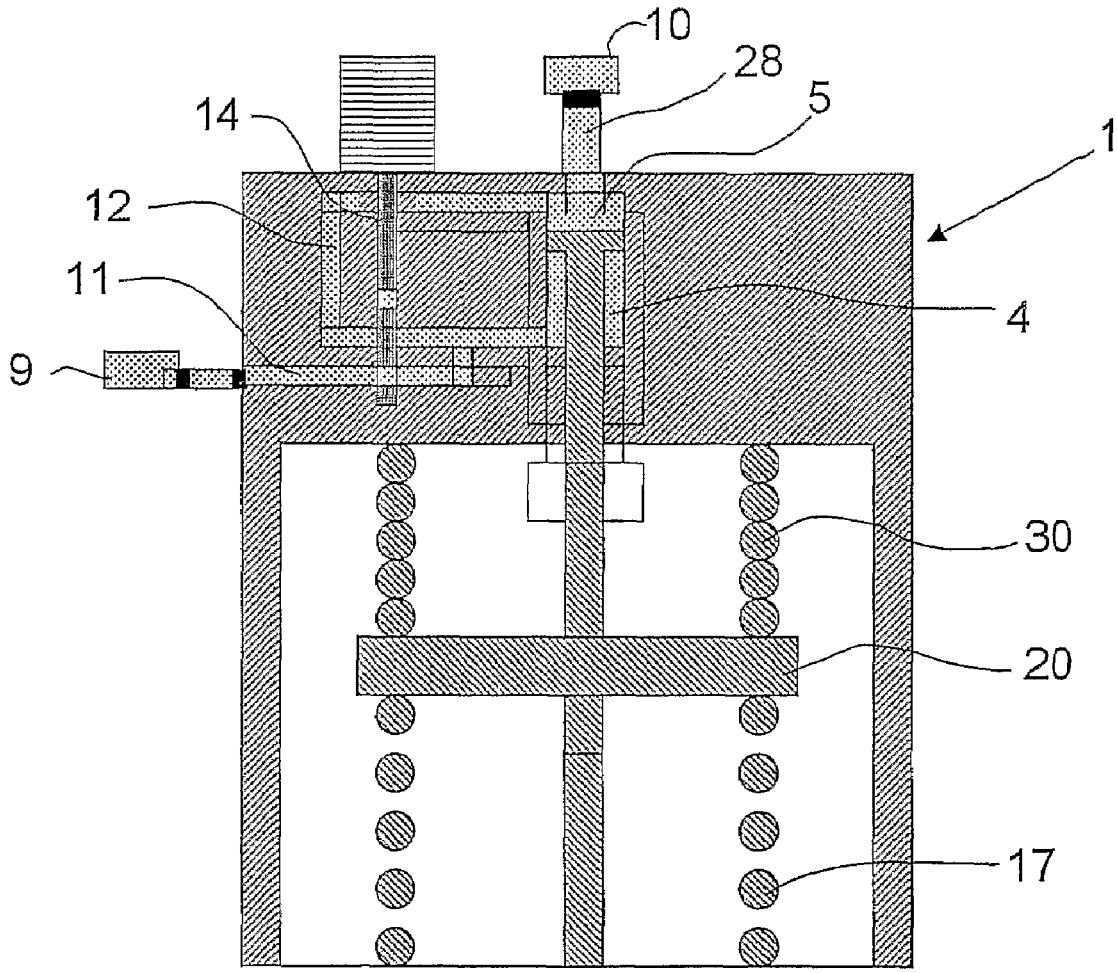
FIG. 4 shows a fourth embodiment of the pressure pulse generator according to the invention.

FIG. 4 shows a simplified embodiment, in which the pneumatic first spring 16 is replaced by a mechanical spring 30, which, however, is not necessary. The second conduit 12, that leads from the first part of the chamber to the low pressure side, does so via the second part 5 of the chamber, and a further conduit 28, corresponding to the fourth conduit 28 in the preceding embodiment. In other words, the second conduit 12 extends from the first part 4 of the chamber to the second part 5 thereof. As to the rest, the pressure pulse generator according to this embodiment, likewise to the one in FIG. 1, comprises a solenoid-activated slide valve 14 for opening/interrupting the communication in the first and second conduits 11, 12 and arranged to interrupt the communication in one of the conduits at the same time as it opens the communication in the other one thereof.

Figure 5:
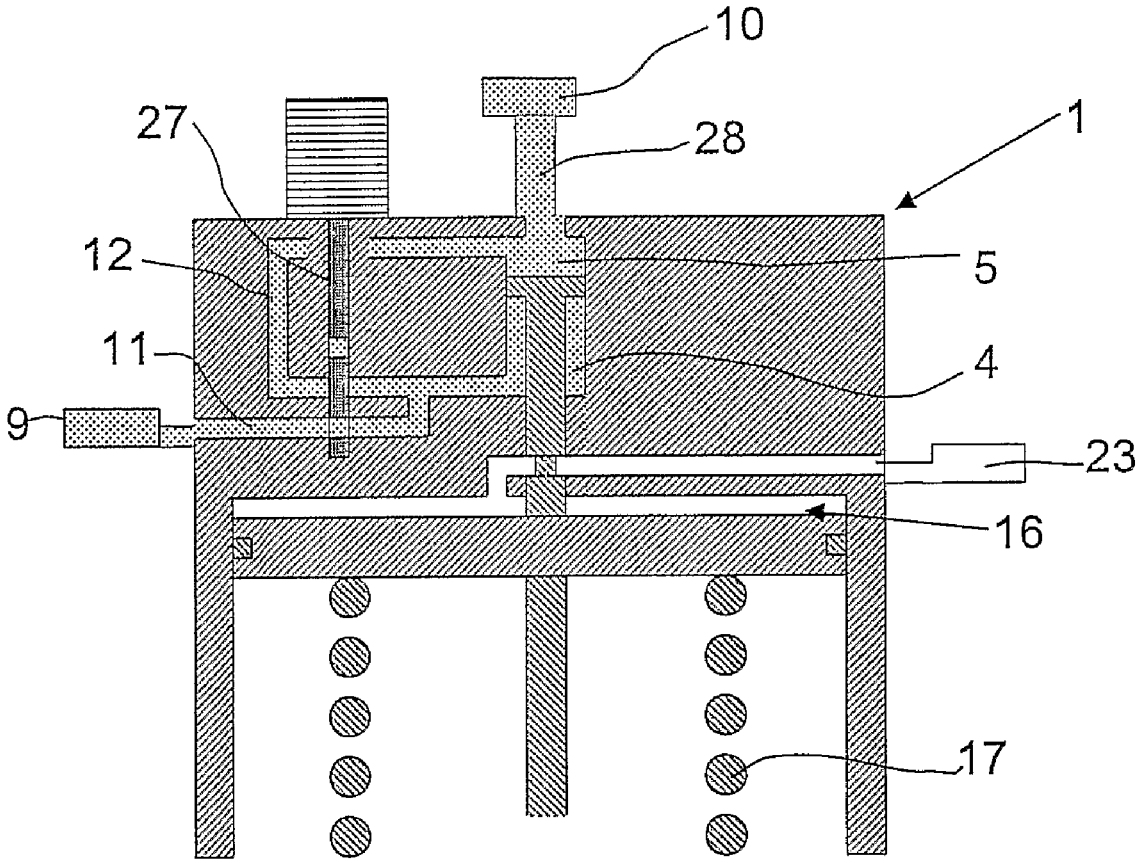
FIG. 5 shows a fifth embodiment of the pressure pulse generator according to the invention.

FIG. 5 shows a further embodiment, corresponding to the one according to FIG. 4, but with the difference that the first spring 16 is a pneumatic spring like the one in FIG. 1.

FIG. 6 shows an embodiment that, generally, corresponds to the one according to FIG. 5, but in which separate solenoid-activated slide valve bodies 33, 34 are used for opening/interrupting the communication in the first and second conduit 11, 12 respectively.

Figure 7:
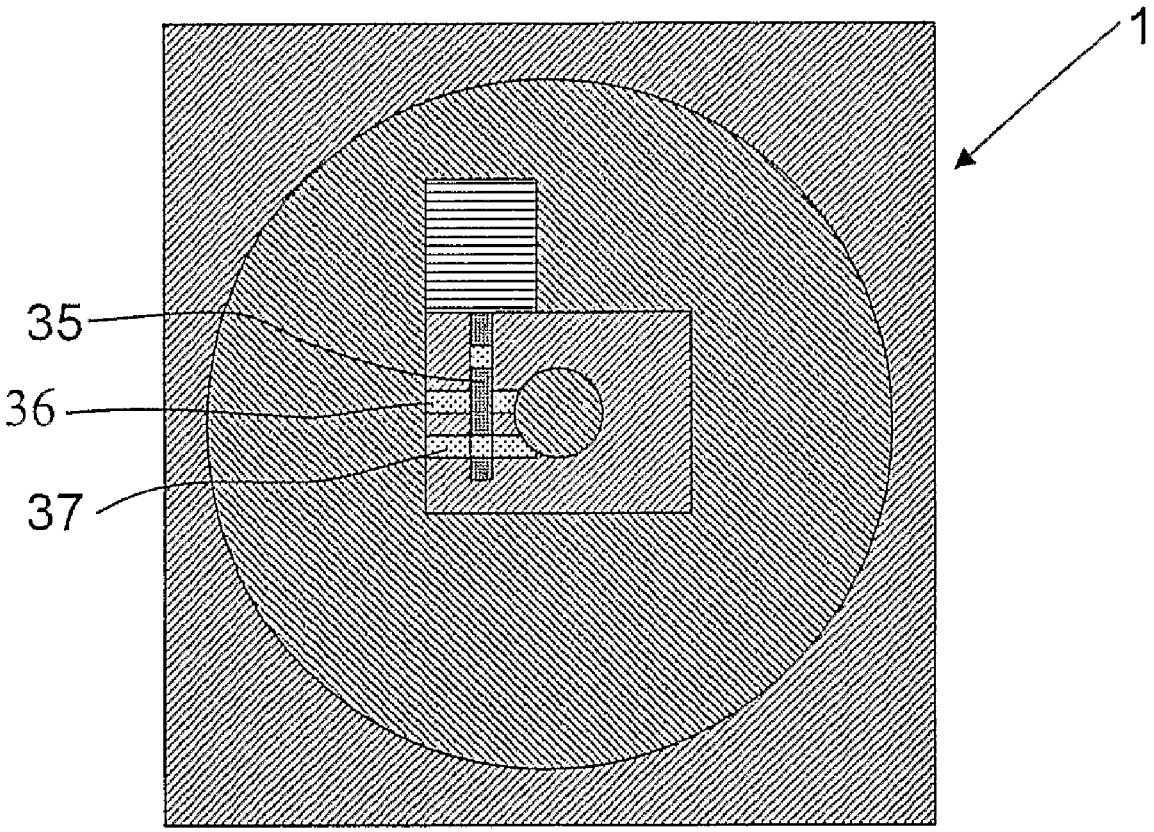
FIG. 7 shows a seventh embodiment of the pressure pulse generator according to the invention.

FIG. 7 is a view from above, showing an embodiment by which a solenoid-activated slide valve body 35 is used for the purpose of regulating the flow in two adjacent conduits. What is unique with this embodiment is that the slide valve body 35 and the conduits 36, 37 are arranged in such a way that the slide valve body can be displaced in a horizontal plane instead of in a vertical plane. In those cases when a minimization of the height of the pressure pulse generator is requested, for example when the latter is located on top of or forms a part of the cylinder head of a combustion engine, the solution shown in FIG. 7 may be advantageous. This might also be the case if it is requested that the gravitation should not have any effect on the position of the slide valve body 35.

Figure 8:
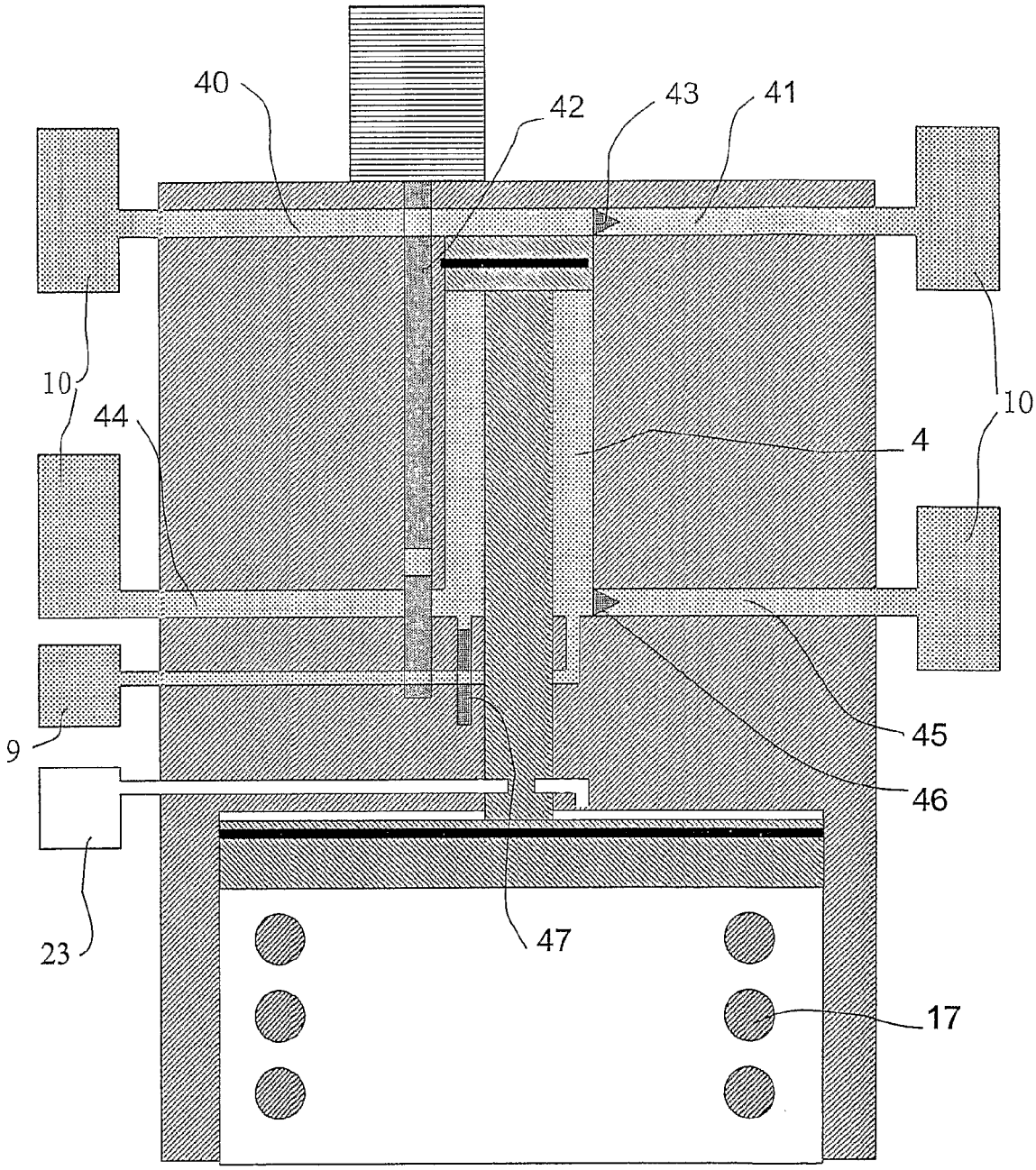
FIG. 8 shows an eighth embodiment of the pressure pulse generator according to the invention.

FIG. 8 shows a further embodiment of the invention. Here, there are two conduits 40, 41 from the second part 5 of the chamber to low pressure sources 10, that could be one and the same low pressure source. A solenoid-activated slide valve body 42 is arranged to open/interrupt the communication in one of said conduits 40, while a non-return valve 43, that closes in a direction towards the low pressure source 10, is arranged in the second conduit 41. Two further conduits 44, 45 lead, in a corresponding way, between the first part 4 of the chamber and low pressure sources, that might be one and the same low pressure source 10. The slide valve body 42 is used for opening/interrupting the communication in one of these conduits 44, and a non-return valve 46, that closes in a direction towards the low pressure source 10, is arranged in the second conduit 45. There is also a conduit 11 between the high pressure source 9 and the first part 4 of the chamber, and a spring-loaded slave valve 47 is arranged in this conduit. The slave valve will, through the action of said spring load, close the conduit 11 if the pressure in the first part 4 of the chamber is insufficient for overcoming the spring force that acts in an upward direction on the slave valve 47 in FIG. 8. The slide valve body 42 is arranged to open/interrupt the communication in this conduit 11. The slide valve body is arranged to open the conduit 11 and the conduit 40 while, simultaneously, interrupting the communication in the conduit 44, and vice versa. When the pressure pulse transmitting body 3 is to be displaced from the home position, shown in FIG. 8, to an end position, the slide valve body 42 is activated, whereupon the communication between the high pressure source 9 and the second part 4 of the chamber is interrupted, and a flow from the second part 4 of the chamber to the low pressure source 10 through the conduit 44 is permitted. When the pressure in the first part 4 of the chamber decreases, the slave valve 47 will close, due to the spring force. The pressure pulse transmitting body 3 reaches an end position, and a return to the home position is to be initiated. However, it will be locked in the end position due to the position of the slide valve body 42. These movements depend on the energy that initially is transferred from the pre-loaded first spring 16 to the second spring 17 and, thereafter, strives to go back to the first spring. In order to release the locked end position, the solenoid/slide valve 42 is reactivated in order to go back to the position shown in FIG. 8. However, the slave valve 47 will remain closed until the moment when the movement of the pressure pulse transmitting body 3 ceases, and a higher pressure, due to the action of the first spring 16, is re-established in the first part 4 of the chamber. Not until then will the communication in the conduit 11 be opened and will there be a complete return of the pressure pulse transmitting body 3 to the starting position.

Although not shown in the figures, it should be realized that the electromagnetically activated, preferably solenoid-activated, slide valves are normally provided with a return spring or the like, for returning the valve body in question when the activation comes to an end. Of course, it is also possible to imagine the use of double solenoids, that act on the valve body in opposite directions, and that cooperate for moving the valve body back an forth between those positions in which the latter opens and interrupts the communication in one or more conduits or connections. An activation of a solenoid, and, thereby, the valve body associated thereto, should be regarded in a wide sense and may include activation as well as deactivation, that is release. All solenoids should be controlled by means of signals from the control unit mentioned earlier in the application, said unit being provided with a computer program for the implementation of the steps according to the method of the invention. The number of solenoid-activated valves used largely depends on how the conduits, in which the flow is to be controlled, are located. A slide valve body may, for example, be provided with a plurality of openings and may be arranged to be responsible for the opening/interrupting of communications in a plurality of conduits.

Moreover, slave valves or pilot valves, that are not directly solenoid-driven, but that are indirectly controlled through a solenoid-activated valve body, may replace or supplement anyone of the means for opening/interrupting the communication between the parts of the chamber, or between each individual part thereof and the high pressure sure source and low pressure source, respectively. Such solutions should be regarded as within the scope of protection defined in the annexed patent claims.

It should also be mentioned that the pressure pulse transmitting body 3, according to an alternative application, may have as its task to directly effect a fuel for the purpose of accomplishing a direct fuel injection into the combustion chamber of a combustion engine.

It should also be mentioned that the house, in which the chamber 2 of the pressure pulse generator, and the pressure pulse transmitting body 3 are arranged, could be the cylinder head of an engine according to the invention. The house may, alternatively, be separate and attached to a cylinder head.

It should be realized that a pressure pulse transmitting body, in all implementations of the invention, either may be directly connected with, in other words, form a part of, a valve body or a VCR-piston that it should act against and drive, or be separate therefrom.

In the applications that have been discussed above, the fluid pressure, the high pressure, is typically 100-500 bar when the fluid is a liquid, typically oil, and 3-30 bar when the fluid is a gas or a gas mixture, typically air.

The invention claimed is:

1. A method of generating pressure pulses through a pressure pulse transmitting body (3) that is displaceably arranged in a chamber (2), by which the flow of pressure fluid into and out of said chamber (2) is controlled electromechanically for the purpose of accomplishing pressure changes for the displacement of the body of a pressure pulse generator that comprises:

said chamber (2), divided by said body (3) into a first and a second parts (4,5), a first spring and a second spring (16,17), arranged to displace said body (3) in a first direction and a second direction respectively in said chamber, a first conduit (11) leading between a high pressure source (9) and a first part (4) of the chamber (2), wherein the pressure fluid in the first part (4) of the chamber acts on said body (3) for displacing the latter in the second direction, and means (13,14) for opening/interrupting a communication between the first part (4) of the chamber (2) and the high pressure source through the first conduit (11), characterized in that—the communication between the first part (4) of the chamber (2) and the high pressure source (9) is kept interrupted during a displacement of the body (3) from a predetermined starting position in the first direction by means of a triggering of the first spring (16), and that the communication between the first part (4) of the chamber (2) and the high pressure source (9) is kept open while the body (3) is displaced back in the second displacement direction to said starting position, whereby a biasing of the first spring (16) is accomplished.

2. A method according to claim 1, characterized in that the communication between the first part (4) of the chamber (2) and the high pressure (9) is opened during a period sufficient for a complete returning of said body (3) to the starting position through the action of the pressure fluid and the second spring (17).

3. A method according to claim 1, characterized in that the communication between the first part (4) of the chamber (2) and the high pressure source (9) is opened during a final stage of the displacement in the second direction, by which the action of the second spring (17) alone is insufficient for a complete returning of said body (3) to the starting position.

4. A method according to claim 1, characterized in that the communication between the first part (4) of the chamber (2) and the high pressure source (9) is kept open for a period during which a retention of the body (3) in the starting position is requested.

5. A method according to claim 1, characterized in that the pressure pulse generator comprises a conduit (12) that leads between the first part (4) of the chamber (2) and a low pressure source (10), and means for opening/interrupting the communication through this conduit (12), and that said communication is kept interrupted when the communication between the high pressure source (9) and the first part (4) of the chamber (2) is kept open.

6. A method according to claim 1, characterized in that the pressure pulse generator comprises a conduit (25,28) for a communication between a low pressure source (10) and the second part (5) of the chamber (2), and means (27) for opening/interrupting this communication, and that the communication is interrupted when the pressure pulse transmitting body (3) has reached an end position, opposed to the starting position, for the purpose of locking the body (3) in its end position.

7. A pressure pulse generator comprising a pressure pulse transmitting body (3) which is displaceably arranged in a chamber (2), said chamber (2), divided by said body (3) into a first and a second parts (4,5), a first spring and a second spring (16,17), arranged to displace said body (3) in a first direction and a second direction respectively in said chamber, a first conduit (11) leading between a high pressure source (9) and a first part (4) of the chamber (2), wherein the pressure fluid in the first part (4) of the chamber acts on said body (3) for displacing the latter in the second direction, and means (13,14) for opening/interrupting a communication between the first part (4) of the chamber (2) and the high pressure source through the first conduit (11), characterized in that—the means for opening/interrupting the communication between the first part (4) of the chamber (2) and the high pressure source (9) are arranged to interrupt the communication therebetween while the body (3) is displaced in the first direction from a predetermined starting position through a triggering of the first spring (16), and arranged to—keep the communication between the first part (4) of the chamber (2) and the high pressure source (9) open while the body (3) is displaced in the second displacement direction back to said starting position, whereby a biasing of the first spring (16) is accomplished.

8. A pressure pulse generator according to claim 7, characterized in that it comprises a conduit (12) that leads between the first part (4) of the chamber (2) and a low pressure source (10), and means for opening/interrupting the communication through this conduit (12).

9. A pressure pulse generator according to claim 8, characterized in that it comprises a conduit (25,28) for a communication between a low pressure source (10) and the second part (5) of the chamber (2), and means (27) for opening/interrupting this communication.

10. A pressure pulse generator according to claim 8, characterized in that the means (13,14) for opening/interrupting the communication in the conduit between the first part (4) of the chamber (2) and the high pressure source (9) comprises a solenoid-activated valve body (14).

11. A pressure pulse generator according to claim 7, characterized in that it comprises a conduit (25,28) for a communication between a low pressure source (10) and the second part (5) of the chamber (2), and means (27) for opening/interrupting this communication.

12. A pressure pulse generator according to claim 11, characterized in that the means (13,14) for opening/interrupting the communication in the conduit between the first part (4) of the chamber (2) and the high pressure source (9) comprises a solenoid-activated valve body (14).

13. A pressure pulse generator according to claim 7, characterized in that the means (13,14) for opening/interrupting the communication in the conduit between the first part (4) of the chamber (2) and the high pressure source (9) comprises a solenoid-activated valve body (14).

14. A pressure pulse generator according to claim 7, characterized in that the means (13,14) for opening/interrupting the communication in the conduit between the first part (4) of the chamber (2) and a low pressure source (10) comprises a solenoid-activated valve body (14).

15. A pressure pulse generator according to claim 7, characterized in that the means (26) for opening/interrupting the communication between the second part (5) of the chamber (2) and a low pressure source (10) comprises a solenoid-activated valve body.

16. A pressure pulse generator according to claim 7, characterized in that the first spring (16) is a pressure fluid spring.

17. A pressure pulse generator according to claim 7, characterized in that the first spring (16) is a mechanical spring.

18. A pressure pulse generator according to claim 7, characterized in that it comprises a control unit with a computer program for a control.

19. A piston engine with a valve for an introduction or discharge of air or an air/fuel mixture in relation to a combustion chamber, characterized in that it comprises a pressure pulse generator according to claim 7.

20. A piston engine with a piston for the variation of the cylinder volume of a combustion chamber in a combustion engine, said piston being arranged displaceably back and forth in a cylinder that is connected with the combustion chamber, characterized in that it comprises a pressure pulse generator according to claim 7 for driving said piston.

* * * * *